United States Patent [19]

Itoyama et al.

[11] Patent Number: 4,949,777

[45] Date of Patent: Aug. 21, 1990

[54] PROCESS OF AND APPARATUS FOR CONTINUOUS CASTING WITH DETECTION OF POSSIBILITY OF BREAK OUT

[75] Inventors: Seiji Itoyama; Kichio Tada; Tsukasa Telashima; Shuji Tanaka; Hiromitsu Yamanaka; Takao Yunde; Hiroaki Iguchi; Nagayasu Bessho, all of Chiba, Japan

[73] Assignee: Kawasaki Steel Corp.

[21] Appl. No.: 251,410

[22] Filed: Sep. 29, 1988

[30] Foreign Application Priority Data

Oct. 2, 1987 [JP] Japan ..... 62-248149
Nov. 30, 1987 [JP] Japan ..... 62-299885

[51] Int. Cl.[5] ..... B22D 11/18; B22D 11/20

[52] U.S. Cl. ..... 164/453; 164/150; 164/155; 164/413; 164/451; 164/454

[58] Field of Search ..... 164/454, 453, 451, 452, 164/413, 155, 150

[56] References Cited

U.S. PATENT DOCUMENTS 4,553,604 11/1985 Yaji et al. ..... 164/453
4,556,099 12/1985 Yamamoto et al. ..... 164/155 X
4,771,821 9/1988 Matsushita et al. ..... 164/453 X
4,774,998 10/1988 Matsushita et al. ..... 164/155 X

FOREIGN PATENT DOCUMENTS 56-7783 2/1981 Japan .
56-95460 8/1981 Japan ..... 164/150
56-95461 8/1981 Japan ..... 164/150
57-97854 6/1982 Japan ..... 164/150
57-115961 7/1982 Japan .
57-152356 9/1982 Japan .
60-44163 3/1985 Japan .
61-219456 9/1986 Japan ..... 164/150
61-226154 10/1986 Japan .
61-232048 10/1986 Japan .
61-289954 12/1986 Japan .

*Primary Examiner*—Nicholas P. Godici
*Assistant Examiner*—J. Reed Batten, Jr.
*Attorney, Agent, or Firm*—Austin R. Miller

[57] ABSTRACT

A continuous casting process introduces the factor of rate temperature change for detecting break out in the cast metal. Introduction of rate of temperature change as a parameter representative of the cast metal condition is successful for avoiding the influence of variation of the casting condition, fluctuation of the powder to be introduced between the casting mold wall and the cast metal, casting speed and so forth. For achieving accurate detection of break out of the cast metal by introducing the temperature change factor, casting mold wall temperatures are measured at various measuring points which are circumferentially aligned. Rates of temperature change at each measuring point and average rate of temperature change of all measuring points are derived and compared for making judgement of possible break out when the difference of the rate of temperature change at each measuring point and the average rate of temperature change becomes greater than a predetermined value.

18 Claims, 3 Drawing Sheets

PROCESS OF AND APPARATUS FOR CONTINUOUS CASTING WITH DETECTION OF POSSIBILITY OF BREAK OUT

BACKGROUND OF THE INVENTION

1. Field of the Invention

The present invention relates generally to a process of continuous casting of a molten metal. More specifically, the invention relates to a technique for detecting of possible break out of cast metal in continuous casting and prevention thereof. The invention also relates to a device for precisely measuring temperature of the casting mold, which is applicable for detection of possible break out of the cast metal.

2. Description of the Background Art

Conventionally, various approaches have been taken for detecting possibility of break out of cast metal in a continuous casting process. In general, the conventionally proposed method of detection of break out of the cast metal takes the temperature variation of the casting mold as a parameter for detection of break out. For example, Japanese Patent First (unexamined) Publication (Tokkai) Showa No. 57-115961 discloses a method, in which temperature of a continuous casting mold is measured at temperature measuring points which are mutually different from each other in the drawing direction. The measured temperatures are compared to each other for detecting temperature variation and thereby detect possibility of break out in a cast metal. On the other hand, Japanese Patent second (examined) Publication (Tokko) Showa No. 56-7783 discloses a method of detection of possible break out by detecting temperature difference in copper walls of a casting mold. Furthermore, Japanese Patent First Publication (Tokkai) Showa No. 57-152356 discloses employment of a thermometric couple disposed in the wall of the casting mold. In the method of Tokkai Showa No. 57-152356, possible break out is detected when the measured temperature once rises above an average temperature and subsequently drops below the average temperature.

Such conventional methods of detection of break out were not complete and not satisfactory due to the following defects. Namely, the temperature of the casting mold is variable depending upon the casting speed to rise according to increasing casting speed and to lower according to decreasing casting speed. Therefore, there is a possibility of mis-detection of the break out of the cast metal when the casting speed fluctuates.

In addition, the detection of break out of the cast metal can be inaccurate when uneveness of powder to be introduced between the casting mold wall and the cast metal exists, or when formation of an air gap occurs.

In order to avoid the defects in the aforementioned prior art, there are some proposals for improvement in detection of the possible break out of the cast metal. For example, Japanese Patent First Publication (Tokkai) Showa No. 60-44163 discloses a method of detection of the break out, in which casting mold wall temperatures are measured at least at two measuring points. Judgement of possibility of break out is made when the measured temperatures at two measuring points are inclined to the higher temperature side in relation to a normal temperature level for a given period of time. On the other hand, Japanese Patent First Publication (Tokkai) Showa No. 61-289954 utilizes a plurality of set reference temperatures to be compared with the measured temperature data for detecting the break out. Japanese Patent First Publication (Tokkai) Showa No. 61-226154 utilizes preset data comparing the wall temperature of the casting mold versus casting speed. Utilizing the preset data, a data component in the temperature data influenced by variation of the casting speed can be successfully avoided. Then, the temperature data at one selected measuring point is compared with that obtained from remaining measuring points. In this Tokkai Showa No. 61-226154, judgement of possible break down is made when the relative temperature between the selected measuring point and the remainder bocomes greater than an upper limit or smaller than a lower limit.

In case of the technique shown in Tokkai Showa No. 60-44163, break out cannot be detected when casting speed is continuously varying or meniscus fluctuating. On the other hand, the method of Tokkai Showa No. 61-289954, increases possibility of mis-detection unless the set reference temperatures are adapted to the casting conditions. Therefore, in such case, set reference temperatures have to be differentiated depending upon the casting conditions. In case of Tokkai Showa No. 61-226154, since it requires precise measurement of parameters adapted to positions of the temperature measurement and casting condition, setting has to be adjusted every time the temperature measuring points are differentiated or the casting condition is changed.

SUMMARY OF THE INVENTION

Therefore, it is an object of the present invention to provide a process of continuous casting including detection of possible break out of a cast metal, which can avoid influence of variation of meniscus position and/or casting condition.

Another object of the present invention is to provide a casting mold wall temperature measuring device which is useful for implementing the break out detection according to the present invention.

In order to accomplish the aforementioned and other objects, a continuous casting process, according to the present invention, introduces the factor of rate of change of temperatures hereinafter referred to as temperature variation speed, for detecting break out in a cast metal. Introduction of temperature variation speed as a parameter representative of the cast metal condition is successful for avoiding the influence of variation of the casting condition, fluctuation in regard to the nature or condition of the powder being introduced between the casting mold wall and the cast metal, fluctuations of casting speed and so forth. For achieving accurate detection of break out of the cast metal by introducing the rate of change of temperature variation factor, casting mold wall temperatures are measured at various measuring points which are circumferentially aligned. Temperature variation speeds at each measuring point, and the average temperature variation speed of all measuring points are derived, and compared for making judgement regarding the likelihood of possible break out when the difference of the temperature variation speed at any measuring point and the average temperature variation speed becomes greater than a predetermined value.

According to one aspect of the invention, a method for detecting break out in continuous casting comprises the steps of:

arranging a plurality of temperature measuring devices at temperature measuring points oriented in circumferential alignment with a given interval on a wall of a continuos casting mold for measuring temperature of the wall at respective temperature measuring points;

deriving the variation speed of temperature at respective temperature measuring points;

deriving an average temperature variation speed based on temperature variation speed of respective temperature measuring points;

deriving a difference between the temperature variation speed at each temperature measuring point and the average temperature variation speed;

comparing the derived difference with a predetermined threshold for detecting abnormal temperature variation of each temperature measuring point; and observing sequential distribution and propagration of abnormal temperature measuring points for detecting possibility of break out when a predetermined pattern of sequential distribution and propagration of the abnormal temperature measuring points is detected.

According to another aspect of the invention, a process of continuous casting comprises the steps of:

feeding molten metal to one end of a continuous casting mold at a given controlled casting speed;

drawing solidifying cast block from the other end of the continuous casting mold at a given casting speed;

measuring the temperature of a wall of the continuous casting mold at a plurality of temperature measuring points oriented in circumferential alignment with a given interval;

deriving variation speed of temperature at respective temperature measuring points;

deriving an average temperature variation speed based on the temperature variation speed of the respective temperature measuring points;

deriving a difference between the temperature variation speed at each temperature measuring point and the average temperature variation speed;

comparing the derived difference with a predetermined threshold for detecting abnormal temperature variation of each temperature measuring point;

observing sequential distribution and propagation of abnormal temperature measuring points for detecting possibility of break out when predetermined pattern of sequential distribution and propagration of the abnormal temperature measuring points is detected; and controlling at least one of pouring speed and drawing speed for preventing the cast block from causing a break out.

The predetermined sequential distribution and propagration pattern of the abnormality includes transferring of the abnormality to adjacent temperature measuring points at both sides. The temperature measuring points are arranged in alignment on a plane perpendicular to the longitudinal axis of the continuous casting mold. The temperature measuring points are oriented downstream of the meniscus.

According to a further aspect of the invention, a system for detecting break out in continuous casting comprises:

a plurality of temperature measuring devices arranged in circumferential alignment with a given interval on a wall of a continuous casting mold for measuring temperature of the wall at respective temperature measuring points and producing casting wall temperature indicative signals representative of the measured temperature at respective temperature measuring points;

first means for deriving variation speeds of temperature at respective temperature measuring points;

means for deriving an average temperature variation speeds based on temperature variation speed of respective temperature measuring points;

second means for deriving a difference between the temperature variation speed at each temperature measuring point and the average temperature variation speed; and third means for comparing the derived difference with a predetermined threshold for detecting abnormal temperature variations of each temperature measuring point, and observing sequential distribution and propagration of abnormal temperature measuring points for detecting possibility of break out when a predetermined pattern of sequential distribution and propagration of the abnormal temperature measuring points is detected.

According to a still further aspect of the invention, an apparatus of continuous casting for casting molten metal to one end of a continuous casting mold at a given controlled casting speed, and drawing solidifying cast block from the other end of the continuous casting mold at a given drawing speed, comprises:

a plurality of temperature measuring device, arranged in circumferential alignment on the wall of the casting mold, for measuring temperatures of the wall of the continuous casting mold at a plurality of temperature measuring points oriented in circumferential alignment with a given interval, each of the temperature measuring device producing a temperature indicative signal indicative of the measured temperature at an associated temperature measuring point;

first means for receiving the temperature indicative signals from the temperature measuring devices and deriving variation speeds of temperature at respective temperature measuring points to produce temperature variation speed data;

second means for receiving the temperature variation data from the first means and for deriving an average temperature variation speed based on temperature variation speed of respective temperature measuring points, the second means producing average temperature variation speed data third means for comparing the temperature variation data of respective temperature measuring points with the average temperature variation speed for deriving a difference between the temperature variation speed data at each temperature measuring point and the average temperature variation speed;

fourth means for comparing the derived difference with a predetermined threshold for detecting abnormal temperature variation of each temperature measuring point;

fifth means for observing sequential distribution and propagration of abnormal temperature measuring points for detecting possibility of break out when predetermined pattern of sequential distribution and propagration of the abnormal temperature measuring points is detected; and sixth means for controlling at least one of casting speed and drawing speed for preventing the cast block from causing break out.

In the preferred construction, the temperature measuring means may comprise:

a hollow cylindrical mounting bolt which is threaded to the wall of the continuous casting mold, the mounting bolt defining an axially extending opening;

a hollow housing disposed within the axially extending opening, the hollow housing including first and second mutually separated cylindrical components, which first cylindrical component is arranged close to the wall of the casting mold and the second cylindrical component is arranged remote from the wall;

a resilient member disposed between the first and second components of the cylindrical housing and designed to push the first component toward the wall;

a seal member carried by the end of the first cylindrical component and mating with the wall surface for establishing a liquid tight seal; and a temperature sensing element disposed within the housing and contacting the wall surface for monitoring the temperature of the wall of the casting mold. The temperature measuring device may further comprise a pushing means for resiliently pushing the temperature sensing element toward the wall surface.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
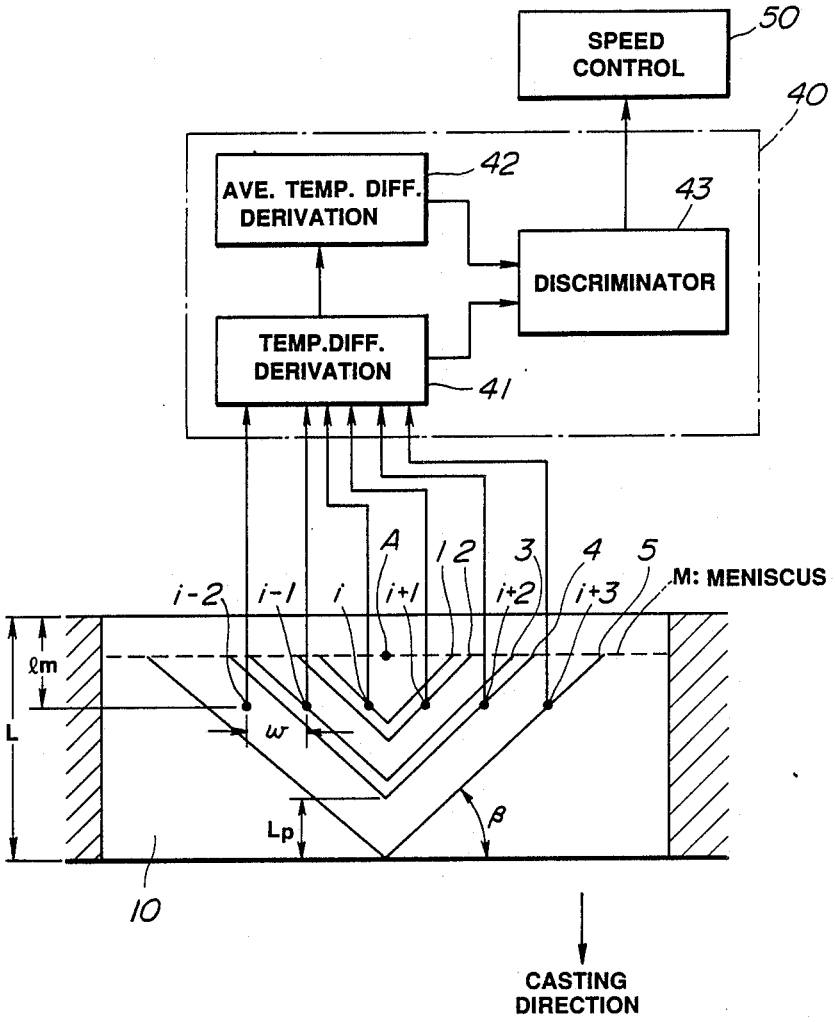
FIG. 1 is an explanatory section of a continuous casting mold with cast metal in the casting mold, showing layout of a plurality of temperature measuring device in circumferential alignment

Referring now to the drawings, particularly to FIG. 1, the preferred embodiment of continuous casting process, according to the present invention, introduces a feature of measurement of temperatures of a casting mold wall 10 at a plurality of temperature measuring points i, i+1, i+2, i+3, i−1 and i−2. The temperature measuring points i, i+1, i+2, i+3, i−1 and i−2 are oriented at positions downstream of a meniscus line M and arranged in circumferential alignment. The temperature measuring points i, i+1, i+2, i+3, i−1 and i−2 are thus circumferentially arranged with a given interval.

It should be appreciated that though the shown embodiment includes one group of temperature measuring points i, i+1, i+2, i+3, i−1 and i−2 circumferentially aligned, two or more groups of temperature measuring points may be used if desired.

Figure 3:
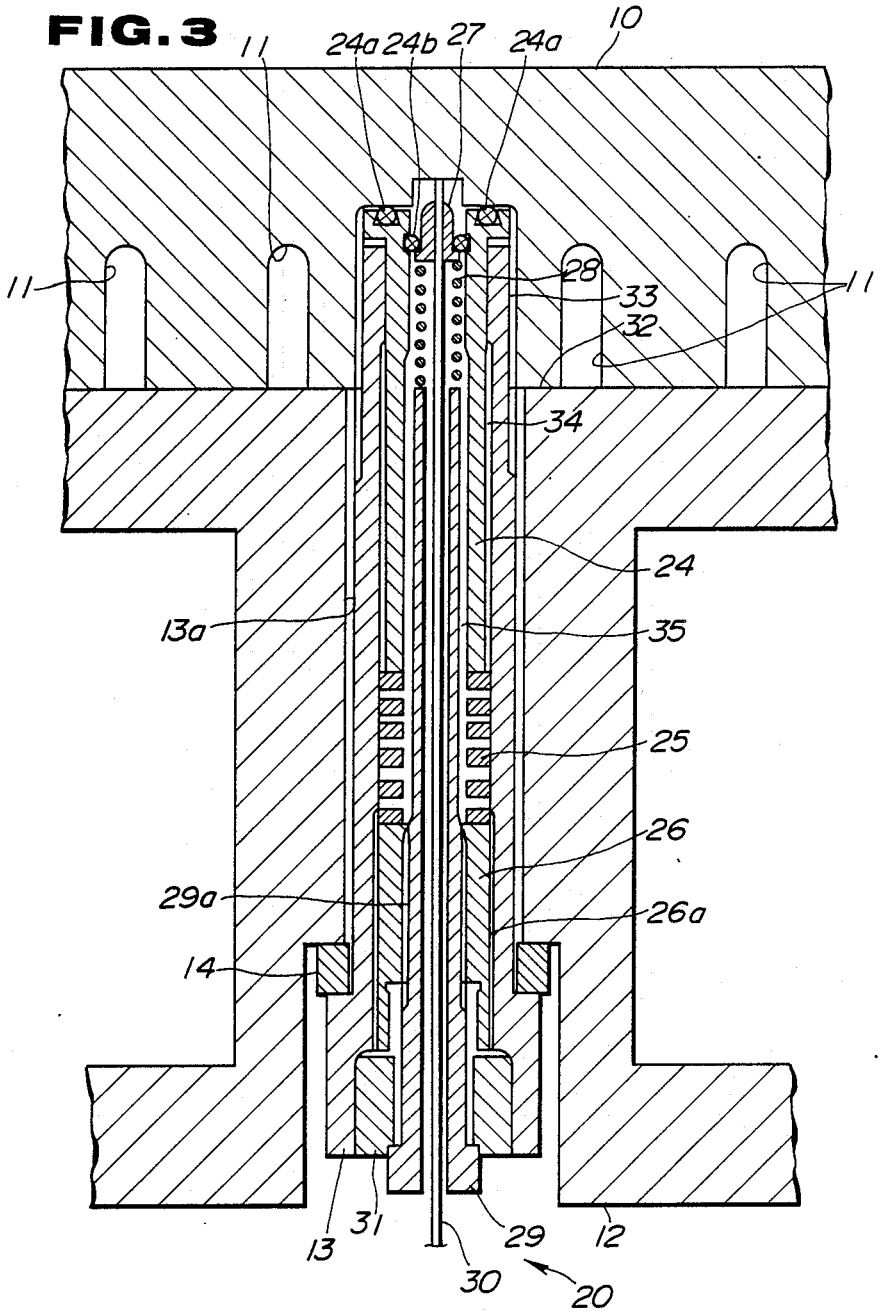
FIG. 3 is a section of the preferred embodiment of a temperature measuring device which is applicable for measuring the temperature of the casting mold wall in the continuous casting.

For each temperature measuring points i, i+1, i+2, i+3, i−1 and i−2, a temperature measuring device 20 of of FIG. 3 is provided. The temperature measuring device 20 is inserted into the casting mold wall of the casting mold 10 for measuring the temperature. The temperature measuring device is designed to monitor the temperature of the wall of the casting mold at the associated temperature measuring point and produces a temperature indicative signal. The detailed construction of the temperature measuring device 20 will be discussed later.

Each of the temperature measuring devices 20 is connected into an arithmetic circuit 40 which includes a temperature variation speed derivation stage 41, an average temperature variation speed derivation stage 42 and a discriminator stage 43. The temperature indicative signals from the respective temperature measuring devices 20 are at first processed by the temperature variation speed derivation stage 41 to derive the temperature variation speed at the respective temperature measuring points. An average temperature variation speed is then derived on the basis of the temperature variation speeds at all of the temperature measuring points in the average temperature variation speed derivation stage 42. Then, the temperature variation speed of each temperature measuring point is compared with the average temperature variation speed to derive a difference in the discriminator stage 43. In the discriminator stage the difference is compared with a predetermined abnormal temperature variation representative criterion to make a judgement whether the temperature variation speed of the temperature measuring point is within the normal range or in an abnormal range. In the discriminating stage 43, the pattern of propagation or transferring of the temperature measuring points where abnormal temperature variation is checked and compared with a preset pattern which is experimentally set in view of past experienced break outs. The discriminator stage 43 outputs a discriminator signal to a speed controller 50 for controlling casting speed and/or casting speed for preventing the cast block from causing a break out.

The process performed by the aforementioned arithmetic circuit will be discussed in detail herebelow. Based on the measured temperature, a temperature variation speed $\dot{\theta}_i$ is derived with respect to each temperature measuring point i, i+1, i+2, i+3, i−1 and i−2. The temperature variation speed $\dot{\theta}_i$ can be derived from the following equation:

$$\dot{\theta}_i=(\theta_i-\theta'_i)/\Delta t \quad (1)$$

where $\theta_i$ is the instantaneous temperature $\theta'_i$ is the temperature at $\Delta t$ before and $\Delta t$ is the period of time.

On the other hand, average temperature variation speed $\dot{\theta}_{av}$ of all of the measuring points (i=1 to N) can be derived according to the following equation:

$$\dot{\theta}_{av} = 1/N \times \sum_{i=1}^{N} \dot{\theta}_i \quad (2)$$

where N is number of temperature measuring points.

From the temperature variation speed $\dot{\theta}_i$ at each temperature measuring point i, i+1, i+2, i+3, i−1 and i−2, and the average temperature variation speed $\dot{\theta}_{av}$, relative temperature variation speed $\dot{\theta}_i^r$ can be calculated by the following equation:

$$\dot{\theta}_i^r=\dot{\theta}_i-\dot{\theta}_{av} \quad (3)$$

When the temperature variation at respective temperature measuring points is caused by a factor other than break out, the gradient of temperature variation speed points becomes substantial equal at respective temperature measuring points. Therefore, in such case, the temperature variation speed can be illustrated by:

$$\dot{\theta}_i = \dot{\theta}_{av}$$

$$\dot{\theta}_i^r = 0°C/s$$

As long as the condition set forth above is satisfied, judgement can be made that temperature variation is caused by a factor other than break out of the cast metal.

Hereafter will be discussed the practical process of detection of break out utilizing the temperature variation speed $\dot{\theta}_i$ at respective temperature measuring points and the average temperature variation speed $\dot{\theta}_{av}$. Here, it is assumed that break out occurs at the point A on the meniscus M between the temperature measuring points i and i+1 or, in the alternative, adjacent the temperature measuring point i. By continuing casting, the relative temperature variation speeds $\dot{\theta}_i^r$ and $\dot{\theta}_{i+1}^r$ at the temperature measuring points i and i+1 are simultaneously increased. Or, in the alternative, the relative temperature variation speed $\dot{\theta}_i^r$ at the temperature measuring point i is at first increased and subsequently the relative temperature $\dot{\theta}_{i+1}^r$ is increased. By further continuing casting, the relative temperature variation speeds $\dot{\theta}_{i-1}^r$ and $\dot{\theta}_{i+2}^r$ at the temperature measuring points i−1 and i+2 are simultaneously increased. Or, in the alternative, the relative temperature variation speed $\dot{\theta}_{i-1}^r$ at the temperature measuring point i−1 is increased and subsequently, the relative temperature $\dot{\theta}_{i+2}^r$ is increased.

As will be appreciated herefrom, when break out occurs in the cast block, the relative temperature variation speeds increase in order. It may also be appreciated from the above discussion that, when break out occurs, variation of the relative temperature variation speed occurs simultaneously or alternatively at both sides of the point at which the break out occurs, in order. To the contrary, when a thermometric couple at one temperature measuring point is damaged, variation of the relative temperature variation speeds occurs at respective temperature measuring points in order in one direction. For instance, assuming the thermometric couple at the temperature measuring point i−1 being damaged, variation of the relative temperature variation speed occurs in order of i−(i+1)−(i+2) . . . Therefore, this type of variation of the relative temperature variation speed can be distinguished from that occurring upon break out.

The variation of the temperature variation speed occurring as set forth above was found as typical phenomena occurring immediately before occurrence of actual break out which is caused by sticking from the analysis of temperature variation data of several tens of examples.

As will be appreciated herefrom, accurate detection of possible break out becomes possible, according to the present invention, by detecting abnormal temperature variation at each temperature measuring point and the propagration characteristics of the abnormality to adjacent temperature measuring points. Since the manner of detection of possible occurrence of break out in cast metal is made based on qualitative analysis of temperature variation occurring at respective temperature measuring points, the method of detection of possible break out is applicable without requiring a substantial change of setting of the parameters.

Here, the maximum abnormality propagration period (T) can be arithmetically obtained from the following equation:

$$T = (w \times \tan \beta)/(\alpha \times V_c) \quad (5)$$

where w is a distance between adjacent temperature measuring points $V_c$ is a casting speed $\beta$ is breaking angle of solidifying shell and $\alpha$ is constant (0.5 to 1.0)

On the other hand, the number of abnormality detecting temperature measuring points to make judgement of possible break out can be determined in relation to the distance Lp from the leading end of the break line to the outlet of the casting mold, casting speed Vc' after detection of possible break out, and period of time td required for deceleration, to satisfy the following relationship:

$$k_s \sqrt{(Lp - \alpha Vc \times td)/Vc'} > d_{B.O} \quad (6)$$

$$Lp = L - lm - (n \times w)/2 \tan \beta \quad (7)$$

where $k_s$ is solidifying speed constant (mm.min$^{-0.5}$) of molten metal in casting mold Vc is casting speed (m/min)

L is a length of casting mold (m)

$d_{B.O}$ is the experimentally obtained minimum thickness (mm) of the solidifying shell which does not cause break out by bulging immediately below the casting mold lm is the distance (m) from the entrance of the casting mold to the temperature measuring points and n is the number of abnormality detecting temperature measuring points for detection of break out of cast metal.

The number of the abnormality detecting temperature measuring points is preferably a maximum number which can satisfy the relationship of formula (6) set forth above. By utilizing the greater number of temperature measuring points for making judgement that break out possibly occurs, occurrence of mis-detection can be reduced.

As will be appreciated herefrom, for detecting possible break out, the following parameters are to be set:

$\dot{\theta}_{cr}^r$ which is upper limit value of the temperature variation speed $t_{cr}$ which is a minimum period of time in which is maintained $\dot{\theta}_i^r \geqq \dot{\theta}_{cr}^r$ $\beta$, $\alpha$, and n.

In practice, $t_{cr}$ is set for avoiding mis-detection lead by temporary fluctuation of the molten metal temperature which causes $\dot{\theta}_i^r \geqq \dot{\theta}_{cr}^r$. Therefore, by providing $t_{cr}$ influence of molten metal temperature fluctuation can be successfully avoided. $\beta$ and $\alpha$ can be obtained from temperature data upon occurrence of break out. Normally, $\beta$ is set in a range of 20° to 45° and $\alpha$ is set in a range of 0.5 to 1.0. On the other hand, n can be derived from the aforementioned formula (6) and equation (7). Therefore, it is practically required to two parameters, i.e. $\dot{\theta}_{cr}^r$ and $t_{cr}$, to be set. These two parameters may be set based on temperature variation pattern in experienced break out.

EXAMPLE

In order to confirm performance of detection of break out according to the invention, experimental casting was performed according to the casting and temperature measuring conditions set in the following table I.

TABLE I

| | 1 | 2 | 3 |
|---|---|---|---|
| Type of Caster | (Bending Type | (Vertical Mold Bending Type) | (Vertical Mold Bending Type) |
| Kind of Steel | Stainless Steel High Carbon Steel | Steel Plate High Tension Steel | Low Carbon Killed Steel Carbon Killed Steel |
| Size of Block | Thickness 200–260 mm Width 850–1250 mm | Thickness 200–260 mm Width 900–1900 mm | Thickness 230–260 mm Width 800–1900 mm |
| Casting Speed Vc (m/min) | 0.6–1.0 | 0.9–1.4 | 0.9–2.0 |
| Temperature Variation Speed Upper Limit $\dot{\theta}_{cr}'$ (°C/S) | 0.5 | 0.6 | 0.7 |
| Detection Range (m/min) | 0.5 or more | 0.5 or more | 0.8 or more |
| Minimun Period $t_{rc}$ (sec) | 6.0 | 4.0 | 4.0 |
| Temp. Measurement Depth | 22–10 mm | 28–10 mm | 33–10 mm |
| w | 196 mm | 150 mm | 152 mm |
| lm | 250 mm | 330 mm | 272 mm |
| L | 700 mm | 800 mm | 900 mm |
| $\beta$ | 20–45° | 20–45° | 20–45° |
| $\alpha$ | 0.5–0.9 | 0.5–0.9 | 0.5–0.9 |
| n | 2 | 3 | 3 |

During experimental casting, accuracy of detection of break out was checked. In order to compare with the result in the inventive method, comparative experiments for detecting break out were performed in a method according to that disclosed in Tokkai Showa No. 61-226154, set forth above. The results are shown in the following table II.

TABLE II

| Caster Type | | 1 | 2 | 3 |
|---|---|---|---|---|
| Invention | A | 0.00347 | 0.00131 | 0.00202 |
| | B | 40% | 100% | 100% |
| | C | 10% | 0% | 0% |
| Comparative | A | 0.0556 | 0.00409 | 0.00673 |
| | B | 25% | 32% | 30% |
| | C | 18% | 18% | 16% |

In table II above, A indicates occurrence of alarms per one heat, B is the rate of occurrence of break out marks on the surface of cast block in the casting mold upon occurrence of the alarm ((break out mark occurrence 2b)/A(total occurrences of alarms, a)×100), C is occurrence of overlooking of break out ((overlooking occurrence 2c)/(B+overlooking occurence)×100).

Figure 2A:
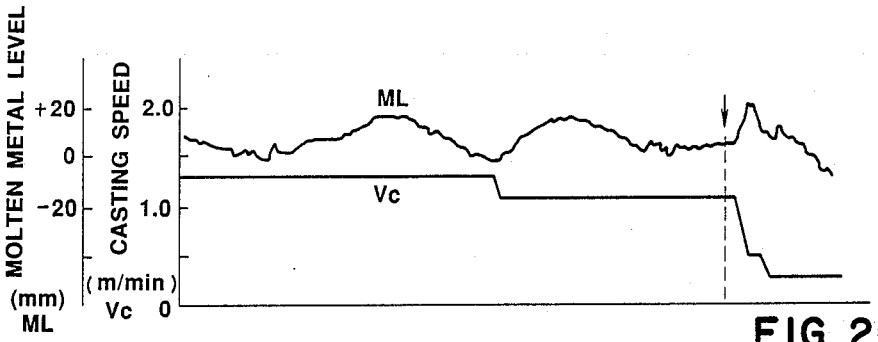
FIGS. 2(A), 2(B) and 2(C) are charts respectively showing variation of molten metal surface level ML, casting speed Vc, casting mold wall temperature and relative temperature variation speed.
Figure 2B:
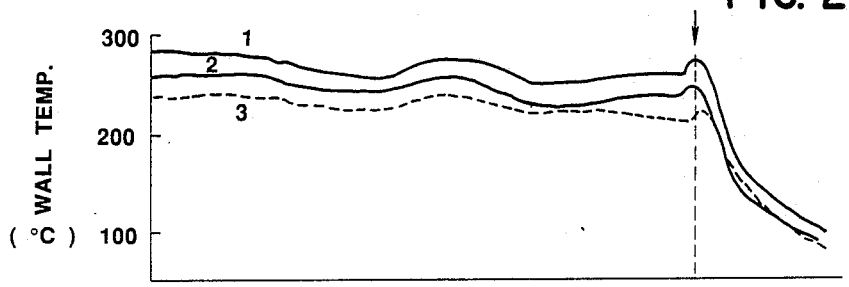
Figure 2C:
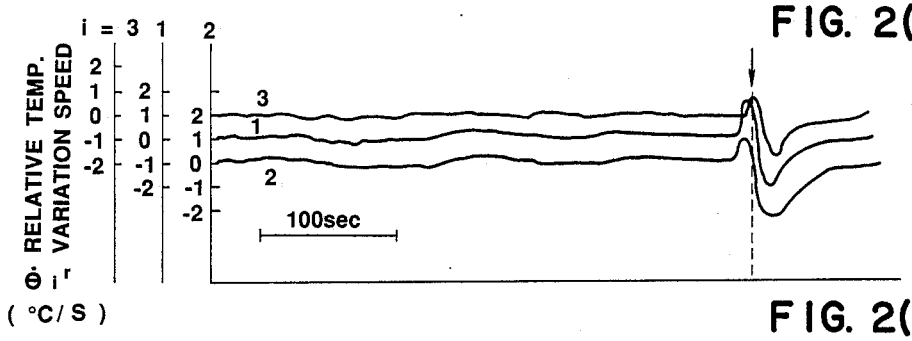

FIGS. 2(A), 2(B) and 2(C) are charts showing variations of molten metal surface level ML, casting speed Vc, casting mold wall temperature and relative temperature variation speed during the experiment, in which possibility of break out is detected. As will be appreciated herefrom, temperature variation speed is maintained essentially unchanged even when the casting speed Vc and the molten metal surface level ML fluctuate at a significant level.

In the process shown in FIGS. 2(A), 2(B) and 2(C), casting speed was decelerated at the timing shown by the arrow in response to an alarm for indicating possibility of break out. In observation of the corresponding portion of the cast block, a marking showing growth of a sticking type break out appeared. From this, it is clearly proven that the method of detection of the break out according to the present invention works very effectively.

FIG. 3 shows the preferred construction of the temperature measuring device which is useful for implementing the preferred process of detection of possible break out. In the shown construction, the casting mold copper wall 10 is formed with a plurality of grooves 11 defining a cooling water path. A cooling water box 12 has a planer section mating with the back surface of the copper wall 10 of the casting mold to stationarily support the copper wall. The cooling water box 12 and the copper wall 10 are rigidly connected to each other by means of a fixing bolt 13. The fixing bolt 13 is formed with an axially extending through opening 13*a*.

The temperature measuring device 20 has an inner cylindrical housing 24 extending through the opening 13*a*. The inner cylindrical housing 24 is slidably disposed within the opening 13*a* and has an end section carrying water seals 24*a* and 24*b*. The rear end of the inner cylindrical housing 24 contacts with one end of coil spring 25 which pushes the cylindrical housing 24 toward the copper wall 10 to establish a liquid tight seal by depressing the water seal 24*a*. To the other end of the coil spring 25, an outer cylindrical housing 26 contacts at the inner end. The outer cylindrical housing 26 has a threaded section 26*a* which engages with a female thread formed on the inner periphery of the opening 13*a*. Therefore, the outer cylindrical housing 26 is thus threaded to the opening 13*a*.

The inner end of the inner cylindrical housing 24 carries a holder 27 via the water seal 24*b*. The holder 27 is axially pushed by a coil spring 28. Through axially extending openings of the cylindrical housings 24 and 26, a thermometric couple introducing tube 29 extends. The thermometric couple introducing tube 29 contacts with the coil spring 28 at the inner end thereof. The thermometric couple introducing tube 29 is formed with a threaded portion 29*a*. The threaded portion 29*a* engages with the female thread formed on the inner periphery of the outer cylindrical housing 26. Therefore, the thermometric couple introducing tube 29 is fixed to the outer cylindrical housing 26.

Through the center opening of the thermometric couple introducing tube 29, a thermometric couple 30 extends to contact the inner end to the copper wall 10. The front end portion of the thermometric couple 30 is gripped by the holder 27. The holder 27 is pushed toward the copper wall 10, by means of the coil spring 28. The inner end of the thermometric couple 30 is resiliently pushed onto the copper wall 10 to assure contact therebetween. The pushing force of the coil spring 28 is regulated by a stopper member 31 which is fixed onto the outer end portion of the outer cylindrical housing 26 and restrict axial movement of the thermometric couple introducing tube 29 toward the copper wall.

Sealing packing 14 is disposed between the outer end portion of the fixing bolt 13 and the inner periphery of the cooling water box 12 for establishing a tight seal and fixing the fixing bolt.

With the construction set forth above, the cooling water leaked from the groove 11 of the copper wall 10 through paths 32 and 33 can be blocked to flow into the inside of the fixing bolt 13 by the water seal 24*a*. On the other hand, the leaked water flowing through paths 32, 33, 34 and 35 can be blocked by the water seal 24*b*. Therefore, the thermometric couple becomes free from influence of the leaked water. Water tight seal established by the water seals 24*a* and 24*b* can be maintained even upon occurrence of thermal distortion of the copper wall 10 because the inner cylindrical housing 24 is resiliently pushed by means of the coil spring 25 to constantly establish a water tight seal by the water seals 24*a* and 24*b*. On the other hand, as the inner end of the thermometric couple 30 held by the holder 27 is constantly pushed toward the copper wall 10 by the coil spring 28, contact between the thermometric couple 30 and the copper wall 10 can be constantly maintained to assure measurement of the temperature of the copper wall.

In the preferred construction, the water seals 24*a* and 24*b* may be formed into an O-ring and made of fluorine, fluon, metal, such as copper, aluminium, or so forth.

In the shown construction, since the thermometric couple 30 extends from the inner end of the holder 27 for a length of 1 mm to 3 mm, buckling may not occur even when a substantially small diameter thermometric couple, such as one having a 1 mm to 2 mm diameter, is used. As is well known, a smaller diameter thermometric couple has a higher sensitivity to the temperature. Therefore, the shown construction allows the temperature measuring device 20 to be satisfactorily sensible of the copper wall temperature.

In addition, by the shown construction, since the inner cylindrical housing 24 carrying the water seals 24*a* and 24*b* will not rotate when fastening to the outer cylindrical housing 26 because it is separated from the outer cylindrical housing via the coil spring 25. Furthermore, presence of the coil spring 28 absorbs the rotational torque to be exerted on the thermometric couple introducing tube 29 when the later is fixed to the outer cylindrical housing 26. By this construction, the water seals 24*a* and 24*b* will never be damaged upon assembling.

EXAMPLE

Experimentally, the temperature measuring device is assembled according to the following specification:

Fixing bolt 13
- outer diameter: 18 mm
- length: 470 mm
- nominal diameter: M18
- opening (inner diameter): 10 mm
- material: SUS 630

Inner cylindrical housing 24
- external diameter: 9.0 mm
- inner diameter: 5.5 mm
- length: 400 mm
- material: SUS 304

Coil spring 25
- external diameter: 9.0 mm
- inner diameter: 5.5 mm
- spring constant: 4 kgf/mm
- material: SUS 304
- section: square Outer cylindrical housing 26
- external diameter: 9.0 mm
- inner diameter: 5.5 mm
- length: 27 mm
- material: SUS 304

Holder 27
- material: copper

Thermometric couple 30
- external diameter 1.0 mm being silver brazed and extended therefrom for the length of 3 mm Coil spring 28
- external diameter: 5.0 mm
- inner diameter: 3.5 mm
- spring coefficient: 1 kgf/mm
- material: SUS 304

Thermometric couple introducing tube 29
- external diameter: 5.0 mm
- inner diameter: 3.5 mm
- length: 440 mm
- material: SUS 304

Utilizing the above-specified temperature measuring device, experimental measurement of the copper wall temperature was performed. In the experiment, fluorine O-rings were used as the water seals 24*a* and 24*b*, which O-rings are provided a resistantive temperatures of 260° C. and 200° C. respectively. The coil springs 25 and 28 are pre-loaded at 11 kg and 5 kg, respectively. The pressure of the cooling water passing through the cooling water path 11 is set at 8 kgf/cm$^2$.

During experimental measurement, leak of the cooling water in the thermometric couple introducing tube 29 was observed. Despite cooling water leakage, the measured temperature was stably maintained within a range of 150° C. to 350° C.

After experimental casting for 500 heats, the temperature measuring device 20 was removed from the fixing bolt 13. In observation of the temperature measuring device 20, a carbonized portion was found on the water seal 24*a* at the portion mating with the copper wall 10. However, no leakage of the cooling water through the water seal was observed.

The shown type of temperature measuring device is advantageously used in the preferred method of detection of possible break out since it does not require disassembling of the casting mold upon installation. Because dissassembling of copper wall upon installation of the temperature measuring device results in releasing of the copper wall from stress which is caused due to distortion, difficulty of re-assembling of the casting mold may occur otherwise. Furthermore, since the shown embodiment of the temperature measuring device can establish complete water seal, stable measurement of the copper wall temperature can be performed. In addition, since the thin thermometric couple can be employed in the temperature measuring device, satisfactorily high sensibility is facilitated. Furthermore, since the shown temperature measuring device is substantially compact and thus allowed to be housed within the fixing bolt, flexibility of installation can be conveniently established.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A method for detecting break out in continuous casting comprising the steps of:

arranging a plurality of temperature measuring devices at temperature measuring points oriented in circumferential alignment with a given interval on a wall of a continuous casting mold for measuring temperature of said wall at respective temperature measuring points;

deriving rates of temperature change at respective temperature measuring points;

deriving an average rate of temperature change based on the rates of temperature change of the respective temperature measuring points;

deriving a difference between the rate of temperature change at each temperature measuring point and said average rate of temperature change;

comparing the derived difference with a predetermined threshold for detecting abnormal temperature change of each temperature measuring point; and observing sequential distribution and propagation of abnormal temperature measuring points for detecting possibility of break out when a predetermined pattern of sequential distribution and propagation of the abnormal temperature measuring points is detected.

2. A method for detecting possibility of break out as set forth in claim 1, wherein said predetermined sequential distribution and propagation pattern of said abnormality includes transferring of the abnormality to adjacent temperature measuring points at both sides.

3. A method for detecting possibility of break out as set forth in claim 1, wherein said temperature measuring points are arranged in alignment on a plane perpendicular to the longitudinal axis of said continuous casting mold.

4. A method for detecting possibility of break out as set forth in claim 3, wherein said temperature measuring points are oriented downstream of the meniscus.

5. A process of continuous casting comprising the steps of:

casting molten metal to one end of a continuous casting mold at a given controlled casting speed;

drawing solidifying cast block from the other end of said continuous casting mold at a given drawing speed;

measuring the temperature of a wall of said continuous casting mold at a plurality of temperature measuring points oriented in circumferential alignment with a given interval;

deriving the rates of temperature change at respective temperature measuring points;

deriving an average rate of temperature change based on the rates of temperature change of respective temperature measuring points;

deriving a difference between the rate of temperature change at each temperature measuring point and said average rate of temperature change;

comparing the derived difference with a predetermined threshold for detecting abnormal temperature change of each temperature measuring point;

observing sequential distribution and propagation of abnormal temperature measuring points for detecting possibility of break out when predetermined pattern of sequential distribution and propagation of the abnormal temperature measuring points is detected; and controlling at least one of casting speed and drawing speed for preventing the cast block from causing break out.

6. A process of continuous casting as set forth in claim 5, wherein said predetermined sequential distribution and propagation pattern of said abnormality includes transferring of the abnormality to adjacent temperature measuring points at both sides.

7. A process of continuous casting as set forth in claim 5, wherein said temperature measuring points are arranged in alignment on a plane perpendicular to the longitudinal axis of said continuous casting mold.

8. A process of continuous casting as set forth in claim 7, wherein said temperature measuring points are oriented downstream of the meniscus.

9. A system for detecting break out in continuous casting comprising:

a plurality of temperature measuring devices arranged in circumferential alignment with a given interval on a wall of a continuous casting mold for measuring temperature of said wall at respective temperature measuring points and producing casting wall temperature indicative signals representative of the measured temperatures at respective temperature measuring points;

first means for deriving rates of temperature change at respective temperature measuring points;

means for deriving and average rate of temperature change based on the rates of temperature change of respective temperature measuring points;

second means for deriving a difference between the rate of temperature change at each temperature measuring point and said average rate of temperature change; and third means for comparing the derived difference with a predetermined threshold for detecting abnormal temperature change of each temperature measuring point, and observing sequential distribution and propagation of abnormal temperature measuring points for detecting possibility of break out when a predetermined pattern of sequential distribution and propagation of the abnormal temperature measuring points is detected.

10. A system for detecting possibility of break out as set forth in claim 9, wherein said predetermined sequential distribution and propagation pattern of said said abnormality includes transferring of abnormality to adjacent temperature measuring points at both sides.

11. A system for detecting possibility of break out as set forth in claim 9, wherein said temperature measuring points are arranged in alignment on a plane perpendicular to the longitudinal axis of said continuous casting mold.

12. A system for detecting possibility of break out as set forth in claim 11, wherein said temperature measuring points are oriented downstream of the meniscus.

13. A continuous casting apparatus for casting molten metal to one end of a continuous casting mold at a given controlled casting speed, and drawing solidifying cast block from the other end of said continuous casting mold at a given drawing speed, comprising:

a plurality of temperature measuring devices, arranged in circumferential alignment on the wall of said casting mold, for measuring temperatures of the wall of said continuous casting mold at a plurality of temperature measuring points oriented in circumferential alignment with a given interval between them, each of said temperature measuring devices producing a temperature indicative signal indicate of the measured temperature at an associated temperature measuring point;

first means for receiving said temperature indicative signals from said temperature measuring devices and deriving rates of temperature change at said respective temperature measuring points to produce rate of temperature change data;

second means for receiving said rate of temperature change data from said first means and for deriving an average rate of temperature change based on the rates of temperature change of said respective temperature measuring points, said second means producing average rate of temperature change data;

third means for comparing said rate of temperature change data of respective temperature measuring points with said average rate of temperature change for deriving a difference between the rate of temperature change data at each temperature measuring point and said average rate of temperature change;

fourth means for comparing the derived difference with a predetermined threshold for detecting abnormal temperature changes of each temperature measuring point;

fifth means for observing sequential distribution and propagation of abnormal temperature measuring points for detecting possibility of break out when a predetermined pattern of sequential distribution and propagation of the abnormal temperature measuring points is detected; and sixth means for controlling at least one of casting speed and drawing speed for preventing the cast block from causing break out.

14. The continuous casting apparatus as set forth in claim 13, wherein said predetermined sequential distribution and propagation pattern of said abnormality includes transferring of said abnormality to adjacent temperature measuring points at both sides.

15. The continuous casting apparatus as set forth in claim 13, wherein said temperature measuring points are arranged in alignment on a plane perpendicular to the longitudinal axis of said continuous casting mold.

16. The continuous casting apparatus as set forth in claim 15, wherein said temperature measuring points are oriented downstream of the meniscus.

17. The continuous casting apparatus as set forth in claim 13, wherein said temperature measuring means comprises:

a hollow cylindrical mounting bolt which is threaded to said wall of said continuous casting mold, said mounting bolt defining an axially extending opening;

a hollow housing disposed within said axially extending opening, said hollow housing including first and second mutually separated cylindrical components, which first cylindrical component is arranged close to said wall of the casting mold and said second cylindrical component is arranged remote from said wall;

a resilient member disposed between said first and second components of said cylindrical housing and designed to push said first component toward said wall;

a seal member carried by the end of said first cylindrical component and mating with the wall surface for establishing a liquid tight seal; and a temperature sensing element disposed within said housing and contacting said wall surface for monitoring the temperature of said wall.

18. The continuous casting apparatus as set forth in claim 17, which further comprises a pushing means for resiliently pushing said temperature sensing element toward said wall surface.

* * * * *